US011434655B2

(12) United States Patent
Scott, Jr.

(10) Patent No.: US 11,434,655 B2
(45) Date of Patent: Sep. 6, 2022

(54) HEADSTONE MARKER FOUNDATION SUPPORT WITH REMOVABLE INSERT

(71) Applicant: IOWAT GROUP INC., Russell (CA)

(72) Inventor: Roy W. Scott, Jr., Palm Beach Gardens, FL (US)

(73) Assignee: IOWAT GROUP INC.

( * ) Notice: Subject to any disclaimer, the term of this patent is extended or adjusted under 35 U.S.C. 154(b) by 208 days.

(21) Appl. No.: 16/906,547

(22) Filed: Jun. 19, 2020

(65) Prior Publication Data

US 2021/0131137 A1 May 6, 2021

Related U.S. Application Data

(60) Provisional application No. 62/931,520, filed on Nov. 6, 2019.

(51) Int. Cl.
*E04H 13/00* (2006.01)

(52) U.S. Cl.
CPC ..... *E04H 13/001* (2013.01)

(58) Field of Classification Search
USPC ..... 248/346.03, 346.01
See application file for complete search history.

(56) References Cited

U.S. PATENT DOCUMENTS 3,477,181 A * 11/1969 Robison ..... E04H 13/003 47/33
3,604,172 A * 9/1971 Matvey ..... E04H 13/003 52/103
3,938,286 A * 2/1976 Mochinski ..... E04H 13/003 47/33
4,869,456 A * 9/1989 Jacobs ..... F16M 5/00 248/346.02
5,250,340 A 10/1993 Bohnhoff
5,664,394 A 9/1997 Sweeney
5,845,436 A 12/1998 Nota
6,904,721 B1 * 6/2005 Forbes ..... E04H 13/008 52/103
7,144,201 B2 12/2006 DeArmond, Jr.
8,561,363 B2 10/2013 DeArmond, Jr.
10,731,303 B2 * 8/2020 Lingle ..... E01C 11/225
2005/0126058 A1 * 6/2005 Rojdev ..... G09F 7/165 40/124.5
2006/0123714 A1 * 6/2006 Sannipoli ..... E04H 13/003 52/103
2008/0034648 A1 * 2/2008 Rasmussen ..... E04H 13/003 47/41.1
2014/0102015 A1 * 4/2014 Toson ..... E04H 13/003 52/741.15
2015/0135612 A1 * 5/2015 Spain ..... E04H 13/003 52/741.15

* cited by examiner

*Primary Examiner* — Monica E Millner
(74) *Attorney, Agent, or Firm* — Agence de Brevets Fournier

(57) ABSTRACT

A foundation support for stabilizing headstones, grave markers, monuments and the like, to prevent sinking or shifting of a grave marker. The foundation support is formed from a rigid base member having a grid of shaped apertures extending between an upper edge and a lower edge that is filled with earth material. An insert member is releasably secured to the base member, the insert member is replacable with a vase insert member to allow personalization of the memorial.

11 Claims, 11 Drawing Sheets

HEADSTONE MARKER FOUNDATION SUPPORT WITH REMOVABLE INSERT

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/931,520, entitled "HEADSTONE MARKER FOUNDATION SUPPORT WITH REMOVABLE INSERT" filed Nov. 6, 2019, the contents of which are incorporated herein by reference.

FIELD OF THE INVENTION

The present invention relates to cemetery markers and, in particular, to a foundation support for stabilizing headstones, grave markers, monuments and the like, to prevent sinking or shifting of a grave marker and provide for a vase or plant holder.

BACKGROUND OF THE INVENTION

A common problem with grave markers is that, being constructed of heavy material such as stone, marble, granite or concrete, the heavy weight of the marker may cause the soil under the marker to shift or sink below the ground surface. Such sinking is commonly due to environmental factors, such as rain, natural erosion, drought conditions and so forth. The headstone or grave marker may lean forward or back, or sink on one end or the other, or both, destabilizing the monument, possibly obscuring the engraved indicia on the marker, and affecting the uniform appearance in the cemetery.

Additionally, when family or friends visit a loved one's grave, it is often customary to leave flowers, plants or other remembrances in a container or vase which may be affixed to the headstone. If the headstone marker is not level, oftentimes the vase affixed to the headstone marker will also have changed position.

It is the responsibility of cemetery maintenance personnel to maintain the grounds of the cemetery to keep the appearance appealing and uniform for the benefit of families and visitors to the cemetery. When a headstone or grave marker has shifted or sunk into the soil, it leaves the marker in an uneven position, which may obscure the information on the grave marker, and also may create difficulty for maintenance personnel in attempting to restore the grave marker back to its original position, affecting the aesthetic appearance of the cemetery.

Having a foundation support installed underground beneath the marker provides a barrier between the heavy marker and the soil underneath it, thereby increasing the support of the marker once it is set over a gravesite so as to reduce the settling or movement of the marker, be it shifting or sinking, which allows for a more uniform appearance in the cemetery, and decreases the need for future maintenance and replacement of the grave marker.

U.S. Pat. No. 8,561,363 discloses an apparatus for stabilizing a headstone. The apparatus employs a rigid perforated member that includes at least one anchor extending away from the perforated member to be driven into the ground. The perforated member is placed over the headstone with the headstone extending through a headstone aperture.

U.S. Pat. No. 5,250,340 discloses a mat for stabilizing particulate materials using upstanding cylindrical tubular members disposed on a grid in a rectangular array.

U.S. Pat. No. 7,144,201 discloses a structure for supporting stone-like objects on soil. The stone-like object may be a headstone.

What is lacking in the industry is a device capable of supporting a headstone in a proper position with an optional provision for maintaining a vase.

SUMMARY OF THE INVENTION

Disclosed is a support device for use in stabilizing grave markers or headstones. Grave markers are customarily made of stone, marble, granite, concrete or other heavyweight material and can weigh thousands of pounds. When the marker is placed over a grave, if there is no support under the marker, there may be occasions when the marker may change its position by shifting or sinking due to soil erosion, rain, drought, or other landscape particularities. If a grave marker moves from its original level position, it is difficult to return the marker to its original position due to the weight of the marker.

An objective of the invention is to provide a perpetual aesthetically appealing appearance to a grave marker or headstone by utilizing a support device underground, underneath the headstone, at the time of installation, to reduce the opportunity for sinking or shifting of the headstone due to weather and soil conditions.

Another objective of the instant invention is for use in re-installing and leveling existing headstones or markers that have shifted due to soil erosion or other factors.

Still another objective is to provide a removable recessed insert within the support device into which a vase or planter can be placed and anchored which prevents sinking or shifting of the vase or planter, along with the marker.

Other objectives and advantages of this invention will become apparent from the following description, taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DESCRIPTION OF THE PREFERRED EMBODIMENT OF THE INVENTION

Figure 1:
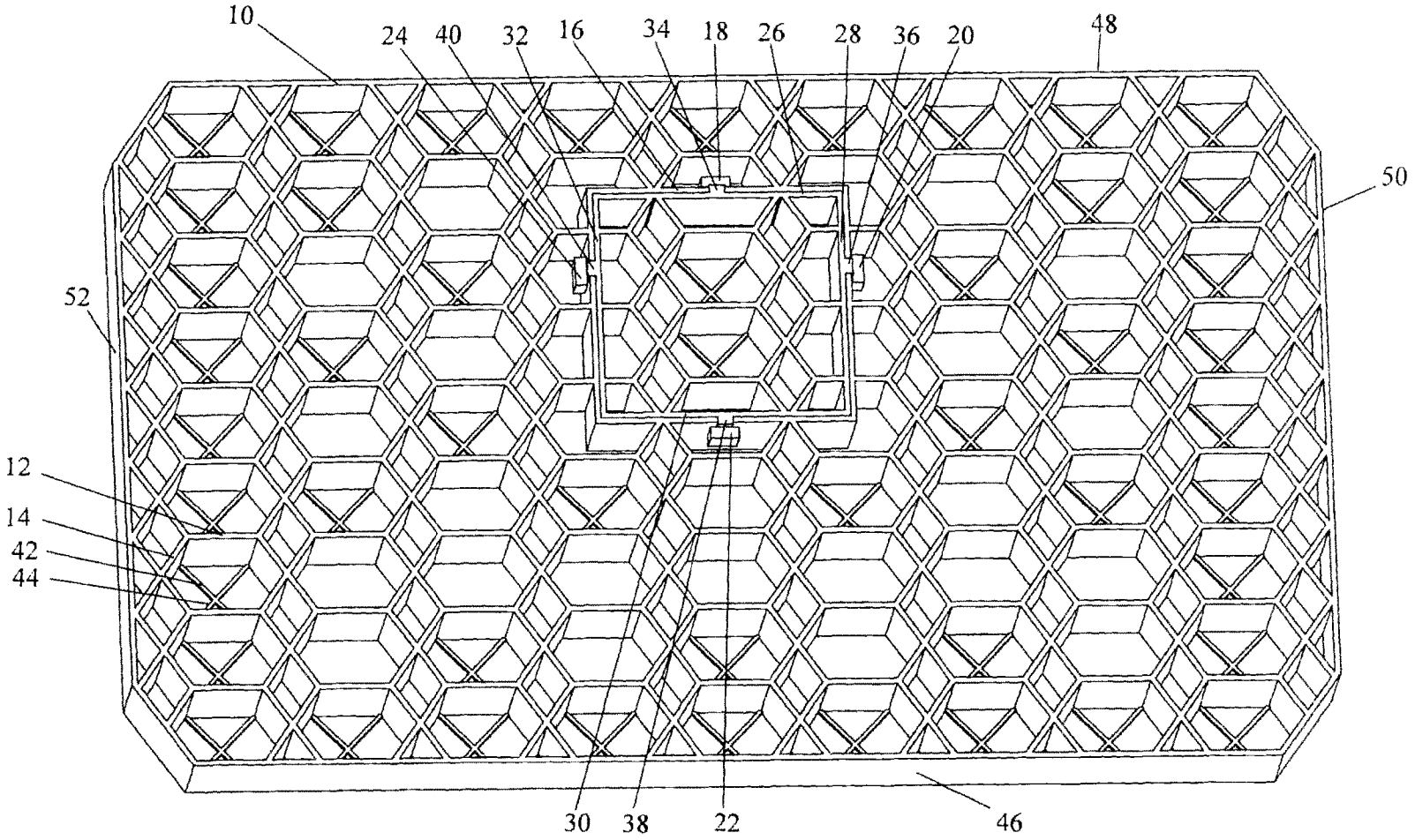
FIG. 1 is a perspective view of the marker support with removable insert.
Figure 2:
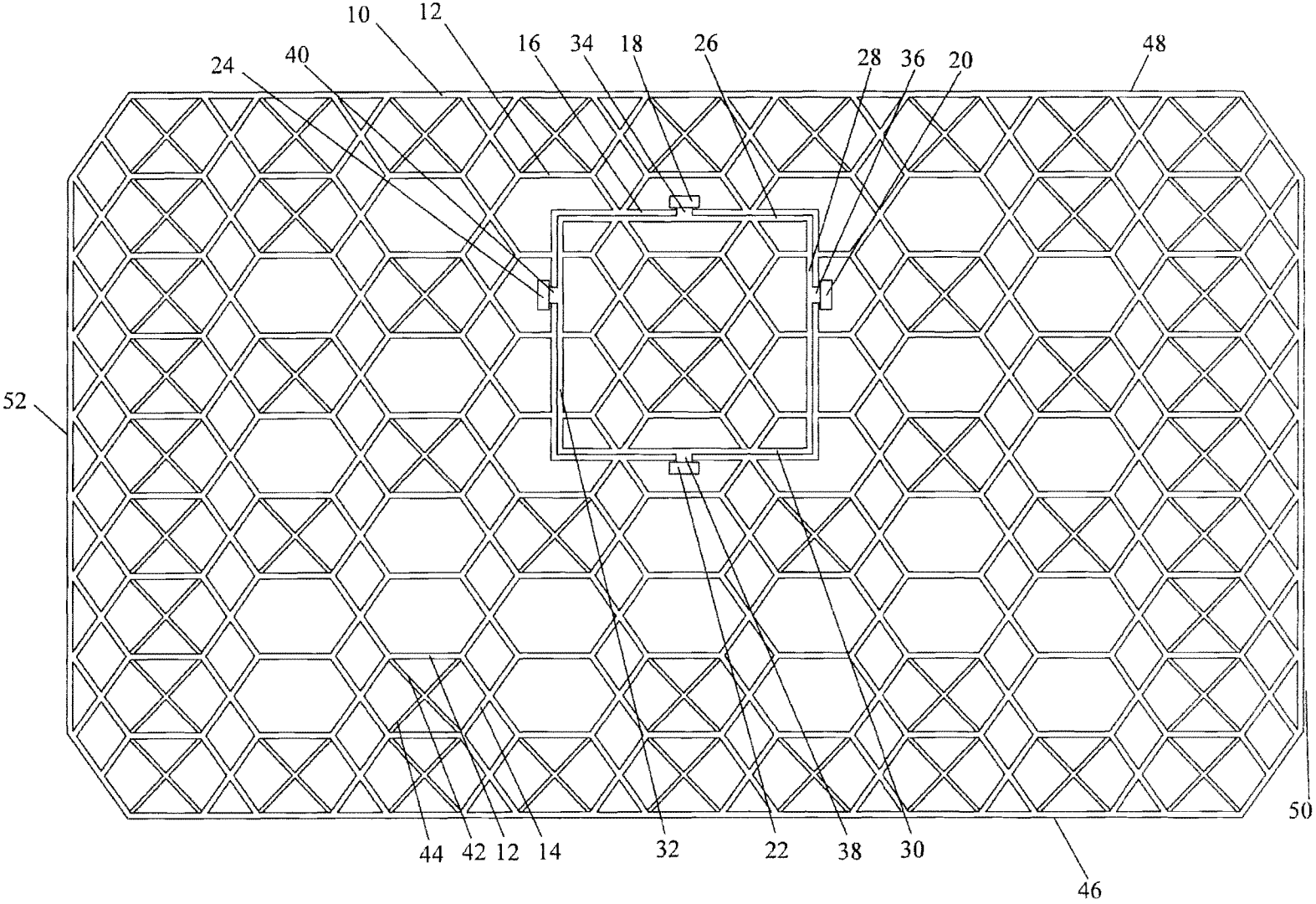
FIG. 2 is a top view thereof.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring to the FIGS. 1-6, disclosed is a support device for installation underneath a headstone, grave marker, monument or the like. For ease of explanation, the terms may be used interchangeably. In a preferred embodiment of the headstone marker foundation support, hereinafter referred to as a base member 10, which is substantially in the shape of a rectangle. The base member 10 is formed of recycled plastic, or other like material that is sufficiently rigid to resist deformation or collapse of the base member 10.

The base member 10 consists of a plurality of diamond shaped members 14 uniformly spaced between hexagonal members 12 formed between a first endwall 50 and a second endwall 52, a first sidewall 46 and a second sidewall 48, and an upper edge 21 and a lower edge 23.

Centrally placed within the grid form is a removable blank insert member 16, having four insertable locking tabs 18, 20, 22 and 24 placed centrally on each outer surface wall 26, 28, 30 and 32 of the removable insert member 16, which insert into vertical openings 34, 36, 38 and 40 and frictionally lock the insert member 16 into place when the locking tabs 18, 20, 22 and 24 are inserted.

The base member 10 intersecting cross members 42 and are used to reinforce the hexagonal members 12 to resist vertical compression, thereby maintaining the base member 10 in a level position.

Figure 3:
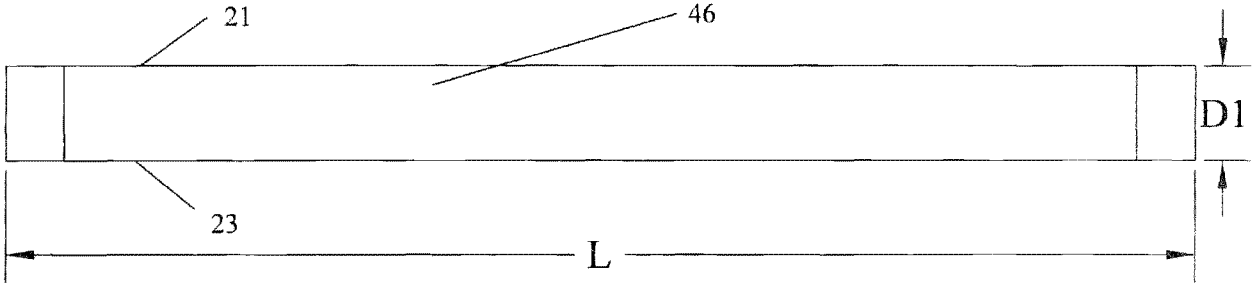
FIG. 3 is a front side view thereof.
Figure 4:
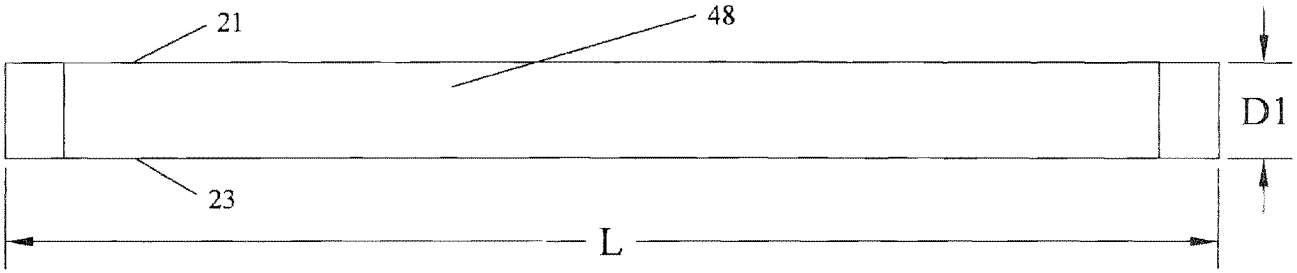
FIG. 4 is a back side view thereof.
Figure 5:
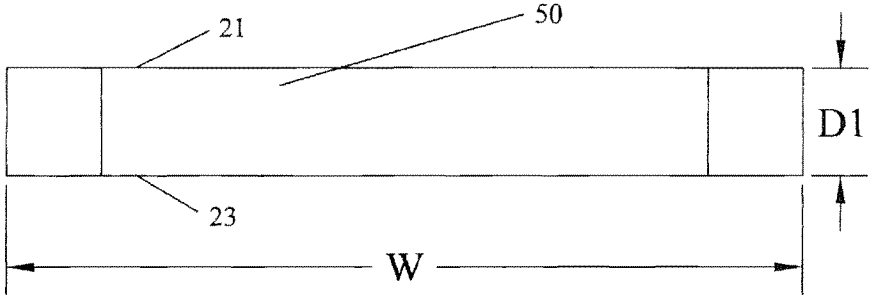
FIG. 5 is a left side view thereof.
Figure 6:
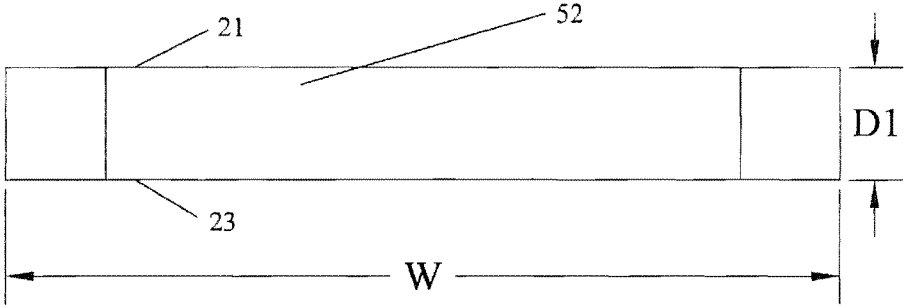
FIG. 6 is a right side view thereof.
Figure 7:
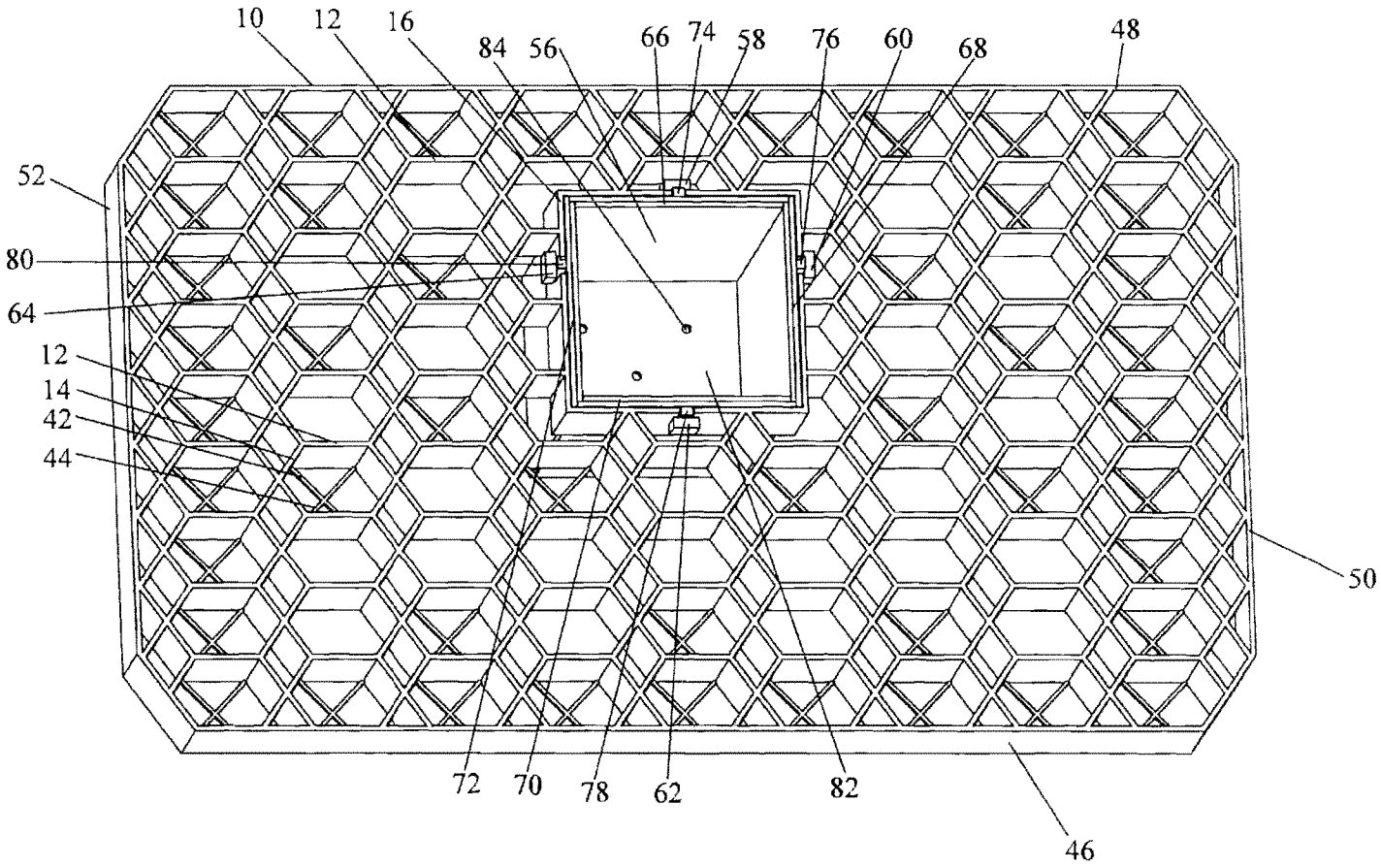
FIG. 7 is a perspective view of the marker support with a vase insert.
Figure 8:
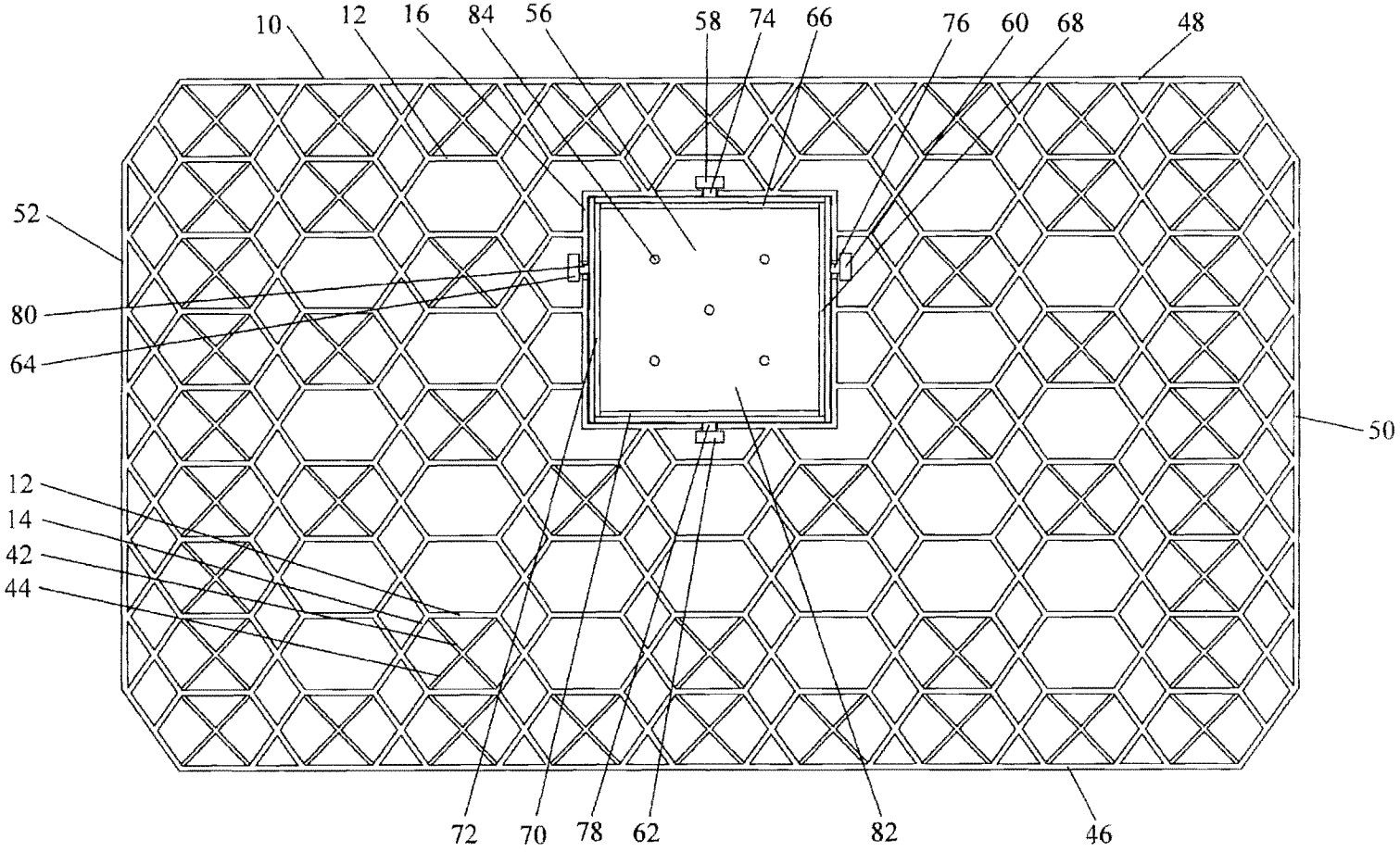
FIG. 8 is a top view thereof.

FIGS. 3 and 4 show the front side 46 and rear side 48, respectively, of the base member 10. FIGS. 5 and 6 show the left side 50 and right side 52, respectively, of the base member 10. In the preferred embodiments the base member 10 can have a width of about 18 inches W and about 28 inches long L, or about 18 inches wide W and about 48 inches long L, or about 18 inches wide W and about 62 inches long L. In a preferred embodiment, the base member 10 is about 2.5 inches deep D1.

FIGS. 7-12 illustrates the replacement of the insert member with a vase insert member 56, having four tabs 58, 60, 62 and 64 placed centrally on each of the outer walls 66, 68, 70 and 72 of the vase insert member 56, which insert into vertical openings 34, 36, 38 and 40 and frictionally lock the vase insert member 56 into place when the locking tabs 58, 60, 62 and 64 are inserted.

The bottom surface 82 of the vase insert member 56 has a plurality of perforation holes 84 to allow for water to seep into the vase insert member 56 to provide moisture from the soil underneath for flowers or plants which may be placed in the vase insert member 56. The vase member 56 illustrated is substantially square and it is understood that the use of rectangular, oval, round or other shape with a matching insert member is within the scope of this invention.

Figure 9:
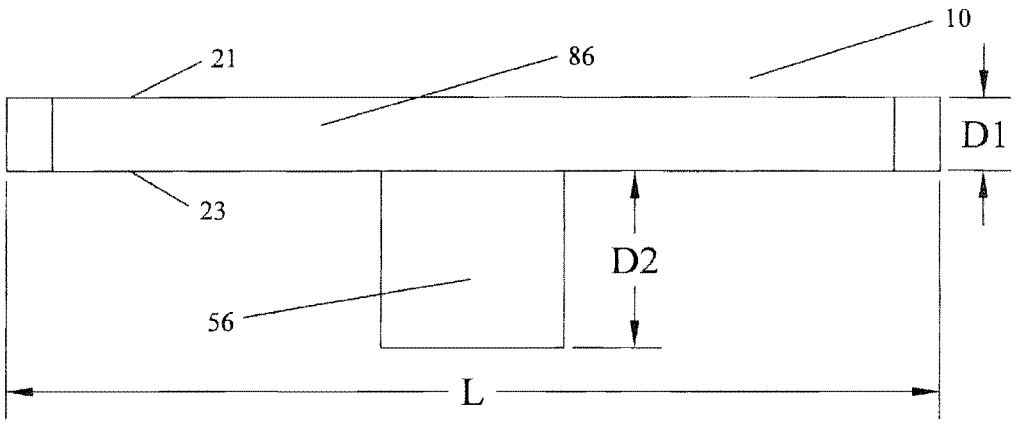
FIG. 9 is a front side view thereof.
Figure 10:
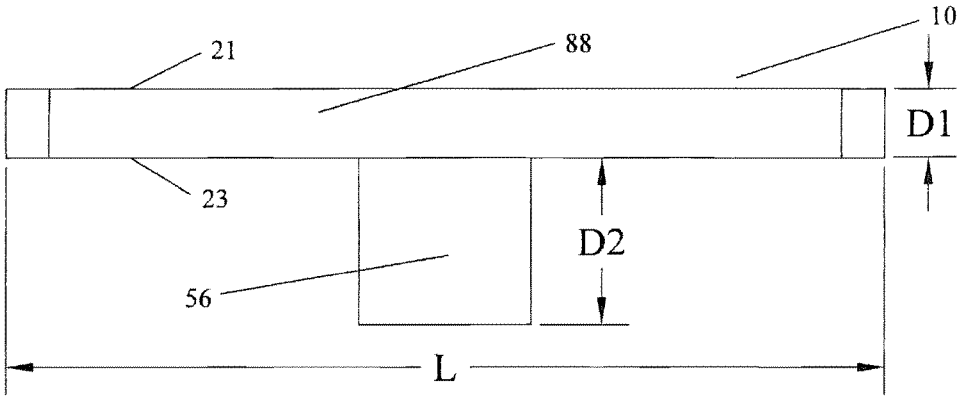
FIG. 10 is a rear side view thereof.
Figure 11:
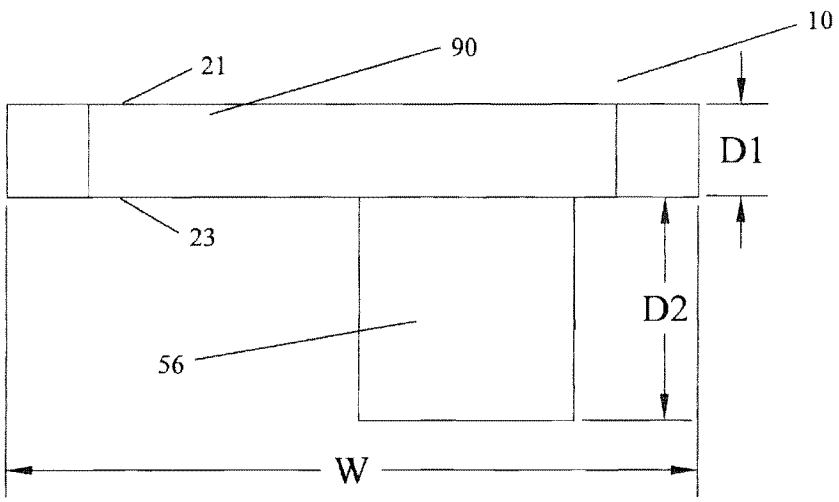
FIG. 11 is a left side view thereof.
Figure 12:
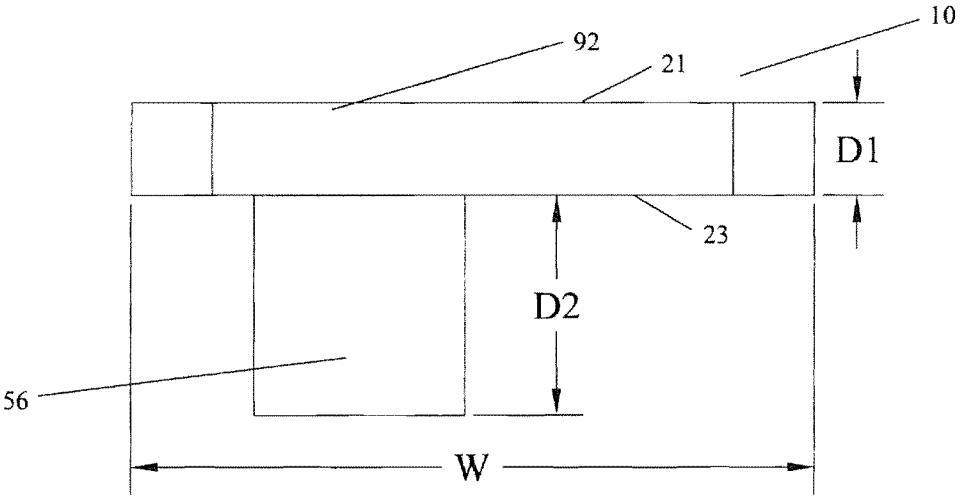
FIG. 12 is a right side view thereof.

FIGS. 9 and 10 show the front side 86 and the rear side 88, respectively, of the headstone base member 10 with the vase insert member 56 installed. FIGS. 11 and 12 show the left side 90 and the right side 92, respectively, of the headstone base member 10 with the vase insert member 56 installed. In the preferred embodiments the base member 10 can have a width of about 18 inches W and about 28 inches long L, or about 18 inches wide W and about 48 inches long L, or about 18 inches wide W and about 62 inches long L. In a preferred embodiment, the base member 10 is about 2.5 inches deep D1 and the vase member 56 extends about 6 inches D2 beneath the base member.

Figure 13:
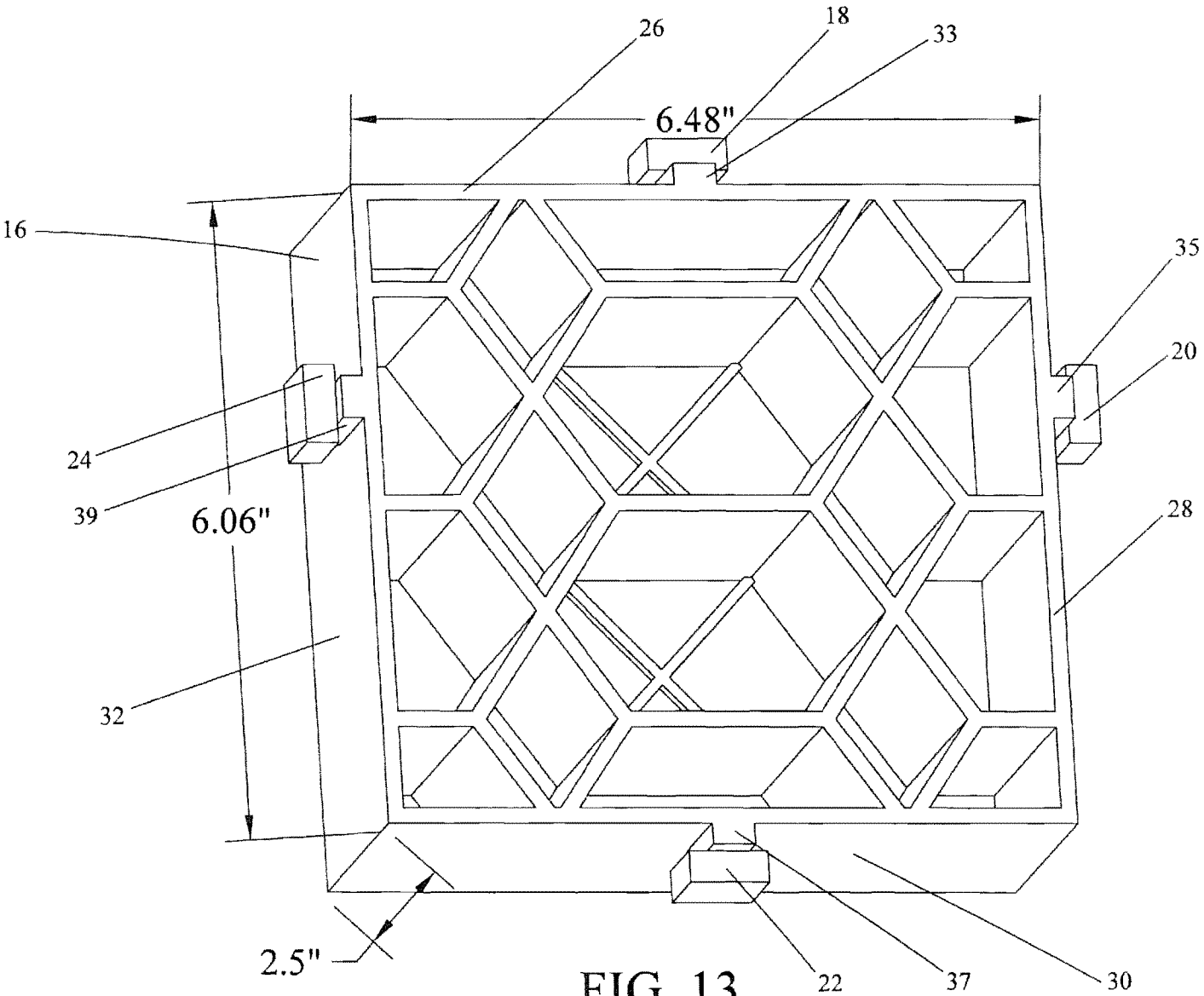
FIG. 13 is a perspective view of the removable portion of the marker support.
Figure 14:
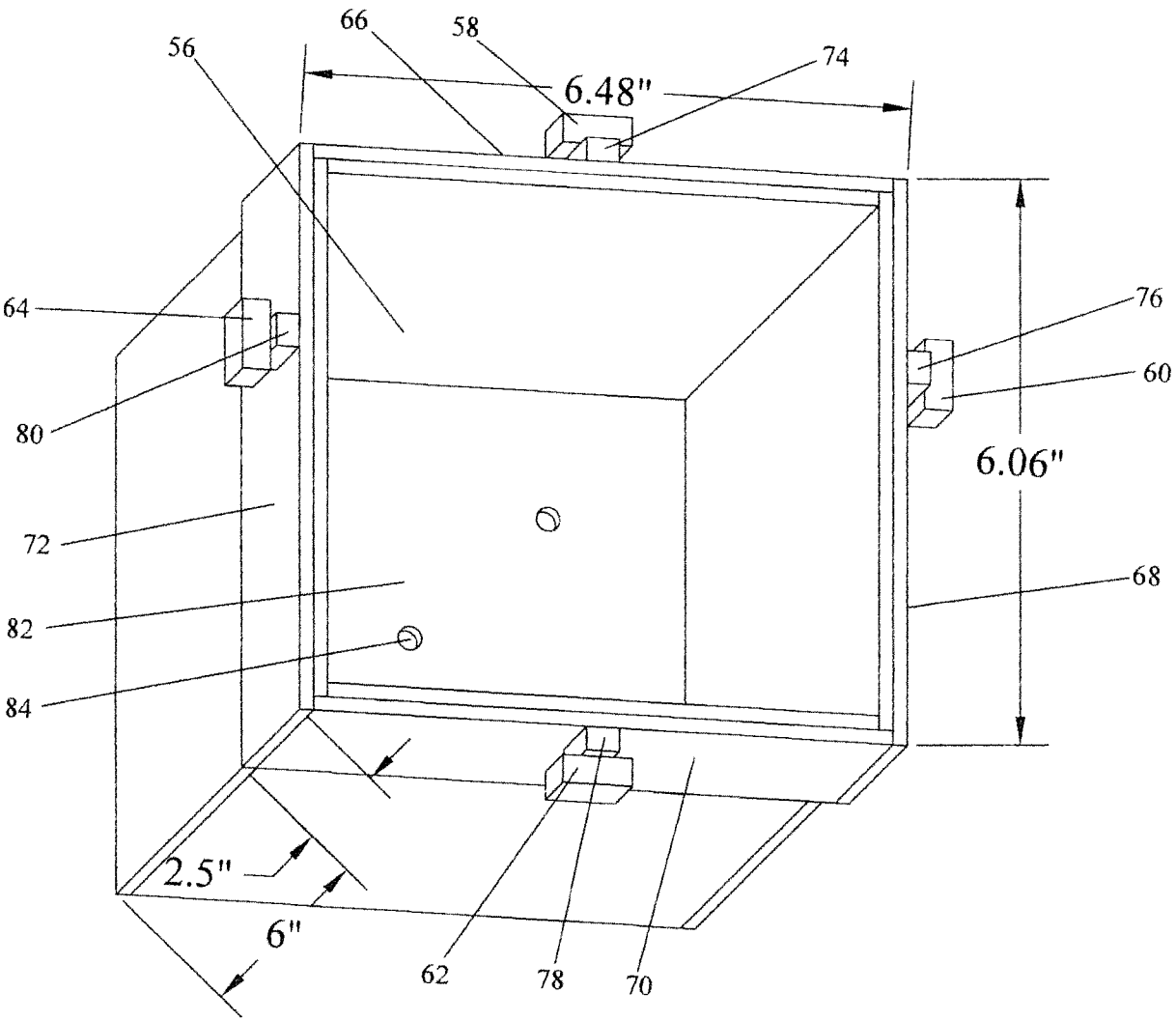
FIG. 14 is a perspective view of the insertable vase insert for the marker support.
Figure 15:
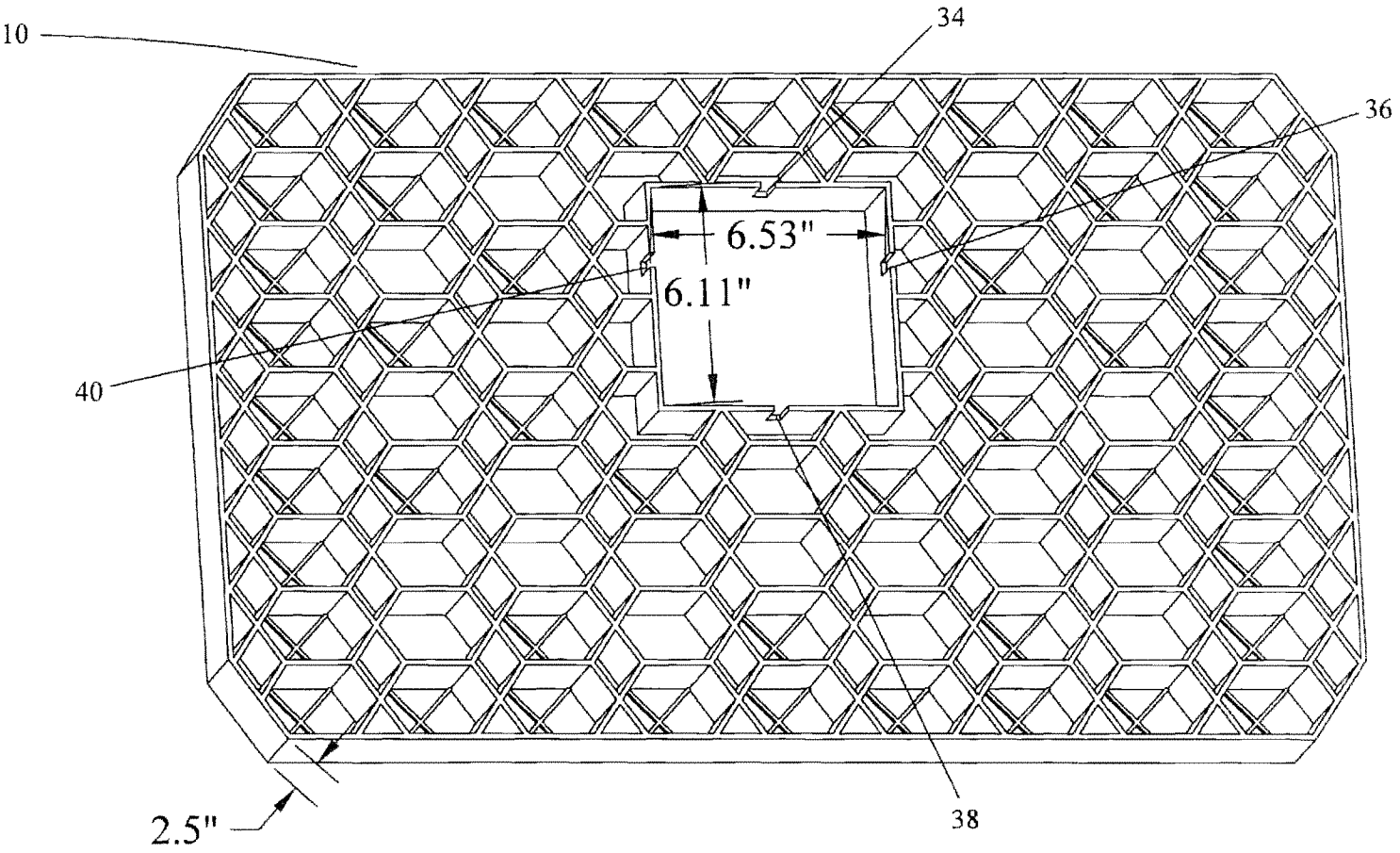
FIG. 15 is a perspective view of the base member without the insert or vase member attached.

FIG. 13 shows the removable insert member 16 as discussed above. Tabs 18, 20, 22, and 24 include spacers 33, 35, 37 and 39 that slide into the vertical openings 34, 36, 38 and 40 respectively for securement. FIG. 14 shows the optional vase insert member 56 as discussed above. The insert member 16 is about 6.5 inches long, about 6 inches wide and about 2.5 inches deep. The vase insert member 56 is about 6.5 inches long, about 6 inches wide and about 8.5 inches deep. Tab spacers 74, 76, 78 and 80 slide into the vertical openings 34, 36, 38 and 40 respectively for securement. The tolerances between the tabs, tab spacers, vertical openings and wall members are constructed and arranged to securely fasten the inset member of vase member to the base member. However, as the material is non-corroding the insert member and vase member may be removed and replaced without special tools. FIG. 15 illustrates the base member 10 without an insert member or vase member to illustrate the vertical openings 34, 36, 38 and 40.

The method of stabilizing the headstone, grave marker, monument or the like comprising the steps of: forming a base member with a plurality of apertures having a length defined between a first endwall and a second endwall, a width defined between a first sidewall and a second sidewall, and a depth measured between an upper edge and a lower edge of said endwalls and said sidewalls, said rigid base including an insert member releasably secured thereto; positioning said upper edge of said base member at ground level; filling said plurality of apertures with earth material; and placing a headstone, grave marker, monument or the like on said base member, said base member constructed and arranged to distribute the weight placed thereon. The method includes the step of: removing said insert member; evacuating about 6" inches of earth material from the opening left upon removal of said insert member; and attaching a vase insert member in place of said insert member; wherein said vase insert member is constructed and arranged to receive a memorial plant.

The use of the word "a" or "an" when used in conjunction with the term "comprising" in the claims and/or the specification may mean "one," but it is also consistent with the meaning of "one or more" or "at least one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A foundation support for stabilizing a headstone, grave marker, or monument comprising:

a rigid base member having a length defined between a first endwall and a second endwall, a width defined between a first sidewall and a second sidewall, and a depth measured between an upper edge and a lower edge of said endwalls and said sidewalls;

a grid of shaped apertures integrally formed between said first and second endwall and said first and second sidewall, each said aperture consists of a vertical sidewall extending between said upper edge and said lower edge; and an insert member releasably secured to said base member; said insert member is a vase insert member, said vase insert member formed from four side walls depending from said base in a substantially square shape having an open top and a bottom wall, said bottom wall having at least one perforation for drainage; wherein each said side wall includes at least one tab constructed and arranged to secure to said base; each said tab is constructed and arranged to secure to a vertical opening in said base member, said tab having a spacer extending through said vertical opening and said tab extending into an adjoining aperture;

whereby said base member is placed at ground level with said apertures filled with earth material, wherein said base member distributes weight of objects placed thereon.

2. The foundation support according to claim 1 wherein said apertures is formed from a grid of hexagonal shaped walls spaced apart by diamond shaped walls extending between said upper edge and said lower edge.

3. The foundation support according to claim 1 including intersecting crossmembers formed along said lower edge of a plurality of said apertures.

4. A foundation support for stabilizing a headstone, grave marker, or monument comprising:

a rigid base member having a length defined between a first endwall and a second endwall, a width defined between a first sidewall and a second sidewall, and a depth measured between an upper edge and a lower edge of said endwalls and said sidewalls;

a grid of shaped apertures integrally formed between said first and second endwall and said first and second sidewall, each said aperture consists of a vertical sidewall extending between said upper edge and said lower edge; and an insert member releasably secured to said base member;

whereby said base member is placed at ground level with said apertures filled with earth material, wherein said base member distributes weight of objects placed thereon;

wherein said insert member is formed from a grid of hexagonal and diamond shaped apertures formed between a first and second endwall and a first and second sidewall, each said aperture consists of a vertical sidewall extending between an upper edge and a lower edge.

5. The foundation support according to claim 4 wherein each said endwall and each said sidewall includes at least one tab constructed and arranged to secure to said base.

6. The foundation support according to claim 5 wherein each said tab is constructed and arranged to secure to said base member, said tab having a spacer extending through a vertical opening and said tab extending into an adjoining aperture.

7. The foundation support according to claim 1 wherein said insert member is a vase insert member, said vase insert member formed from four side walls depending from said base in a substantially square shape having an open top and a bottom wall, said bottom wall having at least one perforation for drainage.

8. The foundation support according to claim 1 wherein said insert member is about 6.5 inches long, about 6 inches wide, and about 2.5 inches deep.

9. The foundation support according to claim 1 wherein said insert member is about 6.5 inches long, about 6 inches wide, and about 8.5 inches deep.

10. A method of stabilizing a headstone, grave marker, or monument comprising the steps of:

forming a base member with a plurality of apertures having a length defined between a first endwall and a second endwall, a width defined between a first sidewall and a second sidewall, and a depth measured between an upper edge and a lower edge of said endwalls and said sidewalls, said rigid base including an insert member releasably secured thereto;

positioning said upper edge of said base member at ground level;

filling said plurality of apertures with earth material;

placing the headstone, grave marker, or monument on said base member, said base member being constructed and arranged to distribute the weight placed thereon;

removing said insert member;

evacuating about 6" inches of earth material from the opening left upon removal of said insert member;

attaching a vase insert member in place of said insert member;

wherein said vase insert member is constructed and arranged to receive a temporary memorial such as a plant.

11. The foundation support according to claim 1 wherein said base member is constructed from plastic.

* * * * *